United States Patent [19]

Mayer

[11] 4,304,192

[45] Dec. 8, 1981

[54] DEVELOPER SEAL

[75] Inventor: Edward F. Mayer, San Jose, Calif.

[73] Assignee: Ricoh Company, Ltd., Tokyo, Japan

[21] Appl. No.: 135,681

[22] Filed: Mar. 31, 1980

[51] Int. Cl.[3] ..... G03G 15/08

[52] U.S. Cl. ..... 118/653; 118/656; 118/658; 118/661

[58] Field of Search ..... 118/657, 658, 653, 656, 118/661

[56] References Cited

PUBLICATIONS

IBM Tech. Disc. Bull. vol. 20, No. 1, 6-77, pp. 27 & 28, Caudill.

*Primary Examiner*—Bernard D. Pianalto

*Attorney, Agent, or Firm*—Claude A. S. Hamrick

[57] ABSTRACT

The present invention relates generally to electrophotographic printing apparatus and more particularly, to a flexible seal means for reducing leakage of toner particles from the developer unit.

5 Claims, 4 Drawing Figures

DEVELOPER SEAL

DESCRIPTION OF THE PRIOR ART

The generation of images on a data carrier such as a paper sheet or web by means of electrostatic copying is well known. In such apparatus, a photoconductive member is charged to sensitize the surface thereof, and the charged member is exposed to a light image of the document to be reproduced. The resulting exposure of the sensitized surface selectively discharges the charge thereon and records an electro-static latent image on the surface which corresponds to the informational areas contained upon the surface of the original document being reproduced.

Development of the electro-static image is achieved by transporting developer materials such as dyed or colored heat settable plastic powders called toner particles into contact with the latent image such that the attractive forces thereof cause the toner particles to transfer from the carrier media onto the sensitized surface.

Although numerous techniques are utilized for applying the developer material to the latent image, one of the most popular techniques is to mix the toner particles with carrier beads or granuals which can be magnetically picked up and transported to a position proximate the sensitized surface of the photoconductive member. In passing by such surface, the greater attractive force of the charged surface exceeds the triboelectrical force with which the particles adhere to the beads and most of the toner particles are removed and become electrostatically attached to the sensitized surface. The carrier beads and remaining toner particles are then returned to a reservoir for reuse. However, in many device configurations, as the toner and carrier particles fall into the reservoir, they create a downward movement of air which tends to slightly pressurize the reservoir and cause toner dust to be blown out of the reservoir and through the gap between the developer and the photoconductive surface. This dust may then contaminate the photoconductive surface as well as other portions of the machine causing improper operation and increased maintenance problems.

One attempt to deal with a related problem is disclosed by Tsukamoto et al in U.S. Pat. No. 4,155,329. However, the Tsukamoto solution concerns itself more with the air flow problem created by the particle carrier transport mechanism than by the problem created by the carrier particles themselves as they are returned to the reservoir and fails to suggest a solution to the latter mentioned problem.

SUMMARY OF THE PRESENT INVENTION

It is therefore a primary objective of the present invention to provide an improved means for reducing toner dust contamination in electrophotographic printing apparatus.

Still another object of the present invention is to provide a simple and inexpensive mechanism which can be added to existing electro photographic systems to seal the toner reservoir and reduce toner leakage.

In accordance with a presently preferred embodiment of the present invention, the developer unit of an electro photographic system is modified by attaching a thin strip of resilient material in cantilever fashion to the lip of the developer housing or the toner carrier return side of the toner reservoir so as to resiliently extend to the developer roller. The strip provides a flexible closure which is pliable enough to be opened slightly by the carrier particles as they are delivered back into the reservoir but which is resilient enough to spring back into a closed position against the roller when no developer mix is being returned to the reservoir. Dust created by carrier/developers particles falling into the reservoir is thus contained within the reservoir and prevented from leaking into other portions of the system.

An advantage of the present invention is that it provides an inexpensive solution to the problem of toner contamination.

Another advantage of the present invention is that it provides a flexible developer unit seal and which is self-actuating and includes no complicated mechanical components.

Still another advantage of the present invention is that it provides a toner reservoir sealing device which can easily be retrofit to existing electrophotographic systems.

These and other objects of the present invention will no doubt become apparent to those of skill in the art after having read the following detailed description of the preferred embodiment.

IN THE DRAWING

DETAILED DESCRIPTION OF THE PREFERRED EMBODIMENTS

Figure 1:
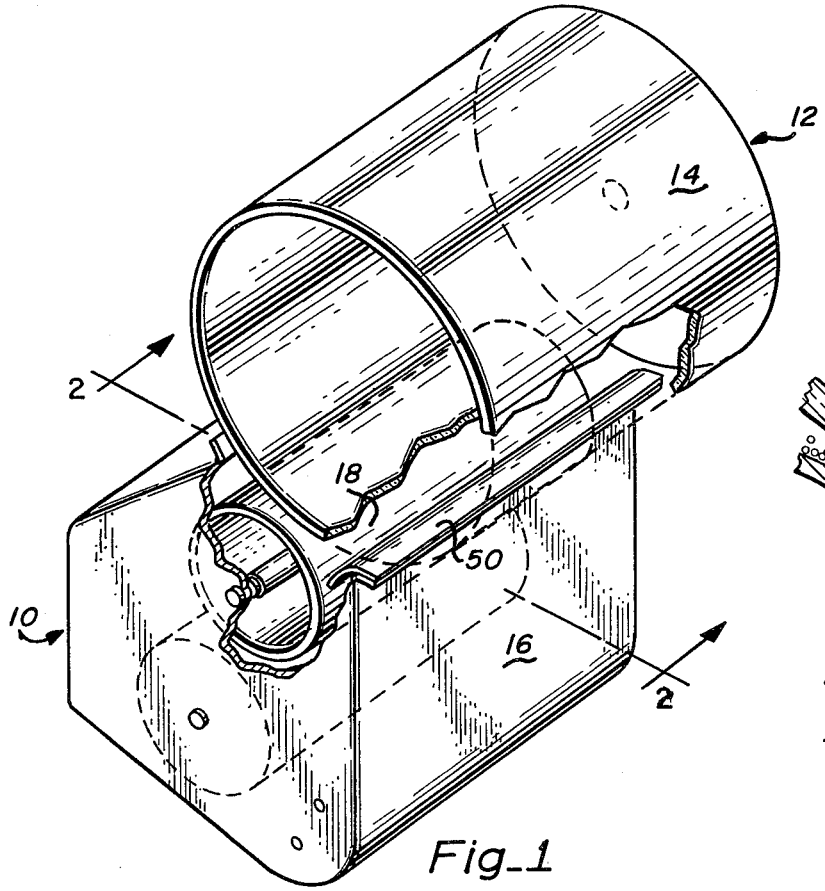
FIG. 1 is a partially broken perspective view showing an electro-photographic developer unit including a flexible seal in accordance with the present invention.
Figure 2:
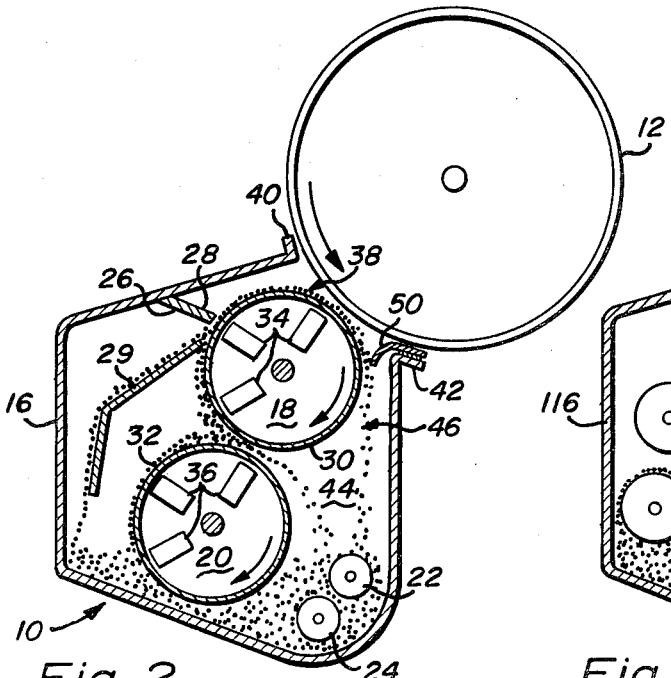
FIG. 2 is a cross section taken along the lines 2—2 of FIG. 1.

Referring now to FIGS. 1 and 2 of the drawing, a developer unit 10 and photosensitive drum 12 forming parts of an electro-photographic system are shown in partially broken form. The drum 12 has a photoconductive surface 14 entrained about and secured to the exterior circumferential surface of a conductive substrate in a manner well known in the art. Mounted beneath drum 12, the developer unit 10 includes an outer housing 16, a developer roller 18, a transport roller 20 (FIG. 2) and a pair of mixer spindles 22 and 24. Affixed to the inner side wall of housing 16 is a doctor blade 26 having an edge 28 which is disposed closely adjacent to developer roller 18 so as to define a gap therebetween that regulates the thickness of developer material allowed to adhere to and be carried by developer roller 18. Also disposed within housing 16 is a guide plate 29 which serves to return carrier and toner particles to the bottom of the container as they are removed from drum 18 by doctor blade 26.

The rollers 18 and 20 form magnetic brushes which consist of cylinders 30 and 32 that are rotatably mounted at their ends to housing 16 and are made of a suitable non-magnetic material such as, for example, brass, aluminum, copper or stainless steel. Disposed within the respective cylinders are permanent magnets 34 and 36 which are appropriately arranged and have magnetic strengths so as to create magnetic fields that will attract magnetic carrier beads or similar carrier particles contained within the reservoir formed by the lower portion of housing 16 and hold such beads in contact with the portion of the periphery of the cylinders disposed within the magnetic fields. This of course allows roller 20 to pick up the beads and triboelectrically attach toner powder and transport it upwardly into close proximity to drum 12.

As will be noted in FIG. 2 of the drawing, the edges of housing 16 surrounding the communicative opening 38 form lips 40 and 42 which are turned back so as to be generally tangent to and conform as close as possible to the surface of drum 12. The lips are however slightly separated from the drum surface so as not to interfere with the turning of the drum or the developer material carried thereby. One of the problems associated with this type of structure is that as the developer material, i.e., the beads and excess toner powder, are carried past the opening 38 and deposited back into the reservoir 44 as indicated at 46 the falling carrier beads and toner material cause air within the reservoir 44 to be displaced and moved around such that an upward flow of toner dust may be caused to be inadvertantly generated in the passage 46 and perhaps even be discharged from the housing by pushing between lip 42 and roller 12.

Figure 3:
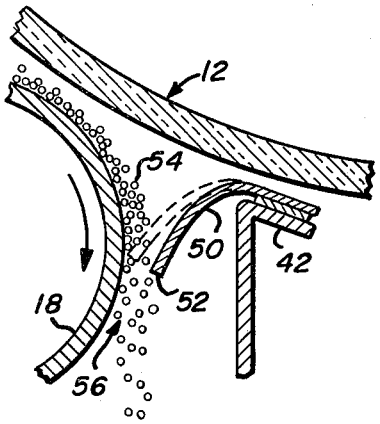
FIG. 3 is an exploded view further illustrating the flexible seal shown in FIGS. 1 and 2.

In order to avoid such discharge, the present invention provides an elongated strip or ribbon 50 of flexible material which is affixed to lip 42 by means of a suitable adhesive or the like and is bowed downwardly along its transverse dimension so that when the system is at rest, the opposite unattached edge resiliently bears against the surface of drum 18. As is perhaps better illustrated in FIG. 3 of the drawing, whereas the edge 52 of strip 50 normally bears against the surface of drum 18 to seal the reservoir 44 closed, as the carrier beads (illustrated at 54) fall away from the surface of drum 18 they contact the upper side of strip 50 and cause it to bow and move edge 52 downwardly forming a return slot 56 through which the material may return to the reservoir. The strip 50 thus forms a floating seal which effectively seals the toner reservoir and prevents blowby of any toner dust generated therein.

In the preferred embodiment, the strip 50 is a thin plastic member which is resilient enough to spring into engagement with drum 18 but which may be easily deflected away from the drum surface by the falling carrier beads. The film could be made of any of several types of plastics, or could even be comprised of thin sheet metal material or the like.

Figure 4:
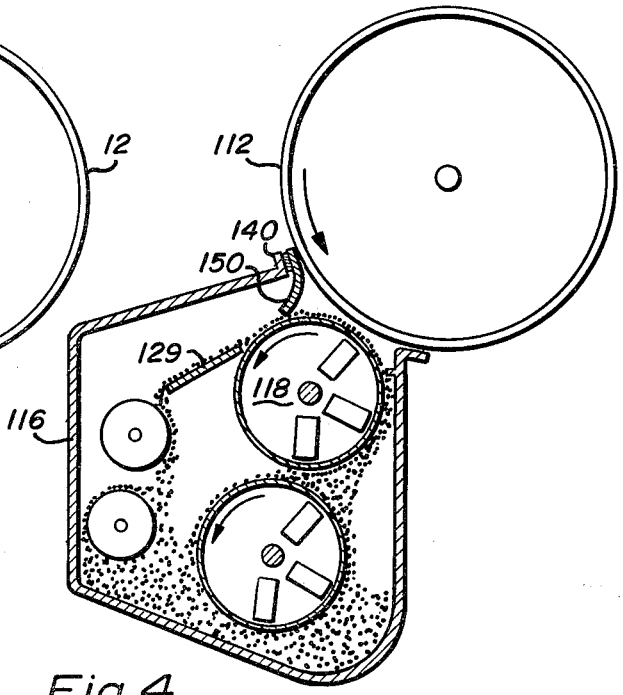
FIG. 4 is a cross section taken through an alternative embodiment including a flexible seal in accordance with the present invention.

Although the dust blow out problem is of particular concern in the case where the facing surfaces of drum 12 and roller 18 move in the same direction, there is also a somewhat lesser problem created in the case where the drum and developer roller are rotated such that their surfaces move in opposite directions, as illustrated at 118 and 112 respectively in FIG. 4. In this case, the strip of film 150 is affixed to the lip 140 on the particle return side of the opening in housing 116 and is bowed against the surface of drum 118 in a manner similar to that depicted in FIGS. 2 and 3. As in the previously described embodiment, beads carried by the roller 118 will deflect strip 150 out of their way as they fall from the roller surface and procede back into the reservoir via guide plate 129.

It will therefore be appreciated that by placing a flexible and resilient strip on the carrier particle return side of the developer roller, an extremely simple but effective means can be provided for reducing contamination which would otherwise deteriorate the background and image carried upon the surface of the developer drum.

Although the present invention has been illustrated in terms of a simple, flexible strip adhesively affixed to the housing of the developer unit, it will be appreciated that similarly configured flexible members could be similarly attached using other means to achieve the same objective. It is therefore intended that the following claims be construed as covering all such alterations and modifications as fall within the true spirit and scope of the invention.

What is claimed is:

1. In an electro-photographic image developing system including a photo conductive member having an image carrying surface, housing means forming a reservoir chamber containing toner material and carrier particles and having a communicating opening facing said surface, and means for carrying a layer of said carrier particles and triboelectrically attached toner material from said chamber to a position within said opening and proximate said image carrying surface and then back into said reservoir through a return passageway formed between one side of said opening and the particle carrying surface of said carrying means, the improvement comprising:

an elongated flexible and resilient strip means for closing said return passageway and having one elongated side affixed to said housing means at said one side of said opening and the other elongated side of said strip means resiliently extending into engagement with the particle carrying surface of said carrying means such that carrier particles transported thereby into said opening past the surface of said photo conductive surface and then to said return passageway cause said resilient strip means to be temporarily deformed away from said particle carrying surface thereby opening said passageway to admit said carrier particles, whereby toner dust created within said chamber is contained therewithin.

2. In an electro-photographic system as recited in claim 1 wherein said strip member is a ribbon of thin plastic material, one side edge portion of which is adhesively affixed to said housing means at said one side of said opening.

3. A developer unit for use in an electrophotographic image producing system comprising:

a photoconductive drum having a photosensitive surface for receiving an electro-static image;

means forming a housing having an opening facing the surface of said drum, such opening being formed by edges of said housing extending into close proximity with the surface of said drum;

roller means disposed within said housing for carrying carrier particles and triboelectrically attached toner particles into close proximity to said drum such that at least some of said toner particles are attracted to said drum and the balance thereof is returned through a return passageway into said chamber; and resilient closure means affixed to one of said housing edges and resiliently extending across said return passageway to normally engage said roller means and close said return passageway, said closure means being deformable by returning carrier particles into a position opening said return passageway.

4. A developer unit as recited in claim 3 wherein said closure means is an elongated thin strip of flexible material one elongated edge of which is attached to said one housing edge.

5. A developer unit as recited in claim 4 wherein said strip of flexible material is a normally flat strip of plastic adhesively affixed to said one housing edge.

* * * * *